US005166025A

United States Patent [19]

Kaieda et al.

[11] Patent Number: 5,166,025

[45] Date of Patent: Nov. 24, 1992

[54] MATRIC PLATE FOR ELECTROPHOTOGRAPHIC PLATEMAKING, PRODUCTION THEREOF AND PRINTING PLATE

[75] Inventors: Osamu Kaieda, Tsukuba; Kiyoshi Masuda, Ushiku; Hideki Ito; Takashi Yodoshi, both of Tsukuba, all of Japan

[73] Assignee: Nippon Shokubai Co., Ltd., Osaka, Japan

[21] Appl. No.: 711,095

[22] Filed: Jun. 6, 1991

Related U.S. Application Data

[63] Continuation-in-part of Ser. No. 544,921, Jun. 28, 1990, abandoned.

[30] Foreign Application Priority Data

Jun. 29, 1989 [JP] Japan ..... 1-165231
Jun. 25, 1990 [JP] Japan ..... 2-166349
Sep. 17, 1990 [JP] Japan ..... 2-246486

[51] Int. Cl.[5] ..... G03G 5/06
[52] U.S. Cl. ..... 430/78; 430/49
[58] Field of Search ..... 430/49, 76, 78

[56] References Cited

U.S. PATENT DOCUMENTS 4,427,754 1/1984 Uchida et al. ..... 430/60
4,461,818 7/1984 Suzuki ..... 430/49
4,725,519 2/1988 Suzuki et al. ..... 430/78
4,748,099 5/1988 Shimada et al. ..... 430/49
4,868,079 5/1989 Khe et al. ..... 430/72
4,981,767 1/1991 Tokura et al. ..... 430/78

FOREIGN PATENT DOCUMENTS 60-17752 1/1958 Japan .
58-76843 5/1983 Japan .
58-145495 8/1983 Japan .
59-147355 8/1984 Japan .
60-243670 12/1985 Japan .
64-45474 3/1988 Japan .
64-23260 1/1989 Japan .
54-89801 7/1991 Japan .
2056348 8/1980 United Kingdom .

*Primary Examiner*—John Goodrow
*Attorney, Agent, or Firm*—Burns, Doane, Swecker & Mathis

[57] ABSTRACT

An electrophotographic plate-making quality matrix plate provided on an electroconductive substrate thereof with a photosensitive layer formed of an alkali-soluble binder resin containing an organic photoelectroconductive compound, which matric plate is characterized by the fact that said organic photoelectroconductive compound is a zinc phthalocyanine represented by the general formula I:

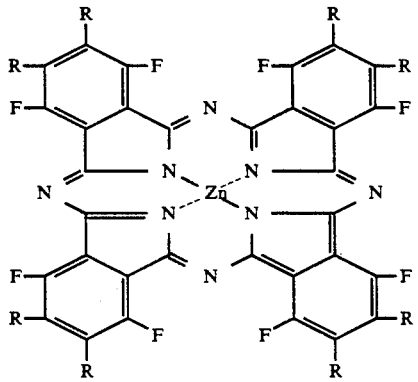

(I)

wherein R is a —SZ group (where Z is a phenyl group, a phenyl group substituted with an alkyl group of 1 to 5 carbon atoms, or a naphthyl group), and said binder resin is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (c) at least one styrene compound, and (d) at least one compound selected from among acrylic esters other than said hydroxyalkyl acryaltes of (a).

22 Claims, No Drawings

MATRIC PLATE FOR ELECTROPHOTOGRAPHIC PLATEMAKING, PRODUCTION THEREOF AND PRINTING PLATE

This is a continuation-in-part application Ser. No. 544,921, filed Jun. 28, 1990, which is now abandoned.

BACKGROUND OF THE INVENTION

1. Field of the Invention

This invention relates to a matrix plate for electrophotographic platemaking, a production thereof and a printing plate obtained by exposing to radiation and developing the matrix plate. More particularly, it relates to a plate-making matrix plate sensitive to a semiconductor laser and capable of directly making a plate by the electrophotographic process, a production thereof and a printing plate obtained by exposing to radiation and developing the matrix plate.

2. Description of the Prior Art

The technological advances in computer image processing and mass storage communication have recently encouraged proposal as a new system of the so-called phototelegraphic printing to be effected by processing a given image with a computer thereby obtaining image information in the form of a digital signal, electrically transmitting the image information with a telephone circuit or a communications . satellite, subjecting the image information reaching the receiver to the operation of a scanner device on the receiver's side, and irradiating this image information with a laser in the scanning manner.

The conventional matrix plate for platemaking has relied predominantly on the method using photosensitive resin (PS plate method). In the case of the PS plate method, since the platemaking is accomplished by causing the received information to be written in a silver salt film as a provisional step, pressing the film fast against a matrix plate, and exposing the film to radiation, this method has a disadvantage that the plate-making operation necessitates a voluminous apparatus and consumes much time. Further, most photosensitive materials for the PS plate method make use of a photochemical reaction and, therefore, require ample exposure to radiation and generally are deficient in sensitivity. Thus, the photosensitive materials of the PS plate method have a disadvantage that they are incapable of producing fully satisfactory image information by the exposure to a low-output inexpensive semiconductor laser.

For the solution of the problems of the PS plate method described above, a method which uses a silver halide photosensitive material for photo-making matrix plate and a method which utilizes the electrophotographic process have been proposed and partly put to practical use. Though the former method enjoys highly satisfactory sensitivity, it suffers from a disadvantage that the plate is deficient in resistance to the impact of printing and is unduly expensive. In contrast, the latter method allows direct platemaking, enjoys relatively high sensitivity and inexpensiveness, and promises successful production of a printing plate highly resistant to the impact of printing. Thus, it has been the subject of active study in recent years.

In the matrix plate for electrophotographic platemaking, zinc oxide and organic compounds have been used as photoelectroconductive substances. The plate-making matrix plate using zinc oxide generally suffers from disadvantages such as (A) the fact that the produced printing plate tends to be defiled because the non-image part thereof is deficient in hydrophilicity, (B) the fact that the produced printing plate is deficient in resistance to the impact of printing because it suffers the photosensitive layer to peel off under the mechanical pressure exerted thereon during the course of printing or owing to the permeation therein of the dampening water, and (C) the fact that the produced printing plate, in spite of sensitization with pigment performed in advance thereon for impartation of sensitivity to the region of visible light, exhibits no fully satisfactory sensitivity in the region of long wavelength exceeding 600 nm and allows no easy effective exposure with a semiconductor laser.

In the case of the plate-making matrix plate using an organic photoelectroconductive compound, the platemaking is accomplished by dispersing the organic photoelectroconductive compound in a binder resin formed mainly of an alkali-soluble resin thereby preparing a photosensitive material, applying the photosensitive material to an abraded surface of a substrate such as of aluminum sheet thereby superposing a photosensitive layer on the substrate, forming a toner image by the electrophotographic technique on the photosensitive layer, and dissolving and removing the non-image part with an alkali extractant.

Numerous electrophotographic plate-making matrix-plates have been proposed which are provided with a photosensitive layer having a varying organic photoelectroconductive compound dispersed in an alkali-soluble resin. For example, JP-A-54-134,632(1979), JP-A-55-105,254(1980), and JP-A-55-153,948(1980) disclose such matrix plates using phenol resin as the alkali-soluble resin. When a phenol resin is used as a binder resin for such a photoelectroconductive organic compound, however, the produced film has a disadvantage that it is brittle and, therefore, deficient in resistance to the impact of printing.

JP-A-58-76,843(1983), JP-A-59-147,355(1984), JP-A-60-17,752(1985), JP-A-60-243,670 (1985), US-A-4,868,079(1989), and JP-A-64-23,260(1989) disclose matrix plates using a styrene-maleic acid copolymer as the alkali-soluble resin. When a styrene-maleic acid copolymer is used as a binder resin for an organic photoelectroconductive compound, however, there arises a disadvantage that the produced film is so hard that the printing plate tends to sustain cracks when it is bent. Acrylic resins have been employed in many cases. JP-A-54-89,801(1979) discloses a matrix plate using an aqueous acrylic resin as a binder resin and an e type crystalline copper phthalocyanine as an organic photoelectroconductive compound. These matrix plates are capable of forming an image by the electrophotographic process. They, however, suffer from a disadvantage that they are not easily etched with an aqueous alkali solution and are incapable of effective exposure to a radiation in the near infrared region such as a semiconductor laser.

JP-A-56-146,145(1981) discloses a method which uses as a binder resin such an acrylic resin as an acrylic acid/methyl methacrylate/butyl acrylate copolymer, for example, and as organic photoelectroconductive compounds a condensed polycyclic quinone type pigment and an oxadiazole derivative. Though the matrix plate obtained by this method allows an etching treatment to be effected easily with an aqueous alkali solution, it has a disadvantage that it possesses no fully satisfactory electrophotographic properties and betrays poor stability to withstand storage for an extended period. It also has a disadvantage that it is incapable of effective exposure to radiation in the near infrared region such as a semiconductor laser. It has a problem of inferior resistance to the impact of printing because it is incapable of effective exposure to radiation in the near infrared region such as a semiconductor laser or, if it is adapted somehow or other to attain the exposure, it exhibits no fully satisfactory behavior as in the electrophotographic properties.

An object of this invention, therefore, is to provide a novel matrix plate for electrophotographic platemaking, a production thereof and a printing plate produced by exposing to radiation and developing this matrix plate.

Another object of this invention is to provide an electrophotographic plate-making quality matrix plate resorting to an improved method using an organic photoelectroconductive compound, a production thereof and a lithographic printing plate.

A further object of this invention is to provide an electrophotographic plate-making quality matrix plate excelling in electrophotographic properties and alkali-extractability, a production thereof and a lithographic printing plate excelling in printing properties.

Still another object of this invention is to provide an electrophotographic plate-making quality matrix plate capable of producing a printing plate excelling in stability to withstand storage for an extended period and resistance to the impact of printing.

Yet another object of this invention is to provide an electrophotographic plate-making quality matrix plate which is furnished with a photosensitive layer excelling in lightfastness and weatherability owing to the use of a binder resin possessing highly satisfactory fast adhesiveness to a substrate and satisfactory mechanical strength.

A further object of this invention is to provide an electrophotographic plate-making quality matrix plate exhibiting high sensitivity even in the region of near infrared wavelength and allowing effective exposure to a semiconductor laser.

SUMMARY OF THE INVENTION

The objects described above are accomplished by an electrophotographic plate-making quality matrix plate provided on an electroconductive substrate thereof with a photosensitive layer formed of an alkali-soluble binder resin containing an organic photoelectroconductive compound, which matrix plate is characterized by the fact that the organic photoelectroconductive compound is a zinc phthalocyanine represented by the general formula I:

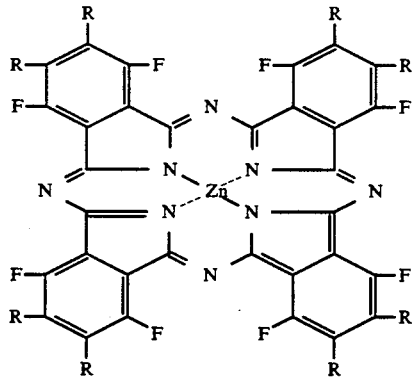

(I)

wherein R is a —SZ group (where Z is a phenyl group, a phenyl substituted with an alkyl group of 1 to 5 carbon atoms, or a naphthyl group), and the binder resin is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (c) at least one styrene compound, and (d) at least one compound selected from among acrylic esters other than the hydroxyalkyl acrylates of (a).

The objects described above are also accomplished by a method for preparing an electrophotographic plate-making quality matrix plate which comprises coating on an electroconductive substrate thereof with a photosensitive layer formed of an alkali-soluble binder resin containing an organic photoelectroconductive compound, which is characterized by the fact that the organic photoelectroconductive compound is a zinc phthalocyanine represented by the general formula I:

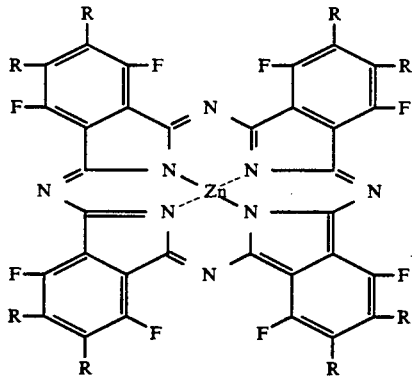

(I)

wherein R is a —SZ group (where Z is a phenyl group, a phenyl substituted with an alkyl group of 1 to 5 carbon atoms, or a naphthyl group), and the binder resin is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (o) at least one styrene compound, and (d) at least one compound selected from among acrylic esters other than the hydroxyalkyl acrylates of (a) and heat-treating said coated substrate.

The objects described above are also accomplished by a lithographic printing plate which is produced by forming a toner image by the electrophotographic process on the electrophotographic plate-making matrix plate described above, fixing the toner image, and removing the non-image part with an alkaline etching liquid.

Since the electrophotographic process on the electrophotographic plate-making matrix plate of the present invention is constructed as described above, it produces the following effects.

(1) It is excellent in electrophotographic properties and capable of effecting electrophotographic plate-making with high efficiency.

(2) It excels in alkali-extractability and allows required etching to be carried out effectively during the course of a plate-making process.

(3) It allows the photosensitive layer thereof to be produced with a low phthalocyanine content in a small wall thickness without adversely affecting the highly desirable states of electrophotographic properties (chargeability and sensitivity).

(4) Since it exhibits highly satisfactory sensitivity even in the region of long wavelength, it can be given effective exposure with not only an ordinary light source such as a tungsten lamp but also a low-output laser. As the result, it allowed direct platemaking to be attained with a varying light source.

(5) The binder resin has high affinity for zinc phthalocyanine and exhibits highly satisfactory dispersibility therein.

(6) The printing plate obtained by the electrophotographic plate-making technique excels in printing properties and allows production of clear prints even after 100,000 cycles of repeated use. It also excels in stability to withstand storage for an extended period.

EXPLANATION OF THE PREFERRED EMBODIMENT

The electrophotographic plate-making quality matrix plate according with the present invention is provided on an electroconductive substrate with a photosensitive layer. This photosensitive layer is formed of an alkali-soluble binder resin containing an organic photoelectroconductive compound.

The organic photoelectroconductive compound to be used in the present invention is a zinc phthalocyanine represented by the aforementioned general formula I. This size phthalocyanine excels in electrophotographic properties even when it is contained in the alkali-soluble binder resin and refrains from interfering with alkali-extractability.

As concrete examples of the zinc phthalocyanines represented by the aforementioned general formula (I), the following compounds may be cited. Invariably in these compounds, a total of eight fluorine atoms are incorporated one each at the 1, 4, 5, 8, 9, 12, 13 and 16 positions of a phthalocyanine nucleus represented by the following formula (II) The formulas enclosed with brackets [ ] are abbreviations.

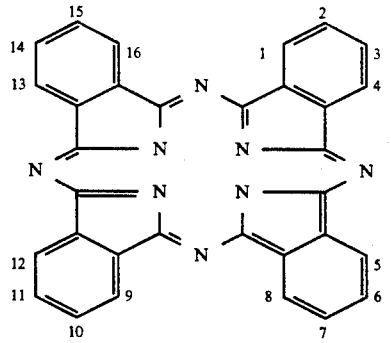

(II)

Octafluoro-octakis(phenylthio) zinc phthalocyanine [$F_8(PhS)_8ZnPc$],

Octafluoro-octakis(o-tolylthio) zinc phthalocyanine [$F_8(o\text{-}MePhS)_8ZnPc$], Octafluoro-octakis(m-tolylthio) zinc phthalocyanine [$F_8(m\text{-}MePhS)_8ZnPc$], Octafluoro-octakis(m-tolylthio) zinc phthalocyanine [$F_8(p\text{-}MePhS)_8ZnPc$], Octacluoro-octakis(2,4-xylylthio) zinc phthalocyanine [$F_8(2,4\text{-}MePhS)_8ZnPc$], Octafluoro-octakis(2,3-xylylthio ) zinc phthalocyanine [$F_8(2,3\text{-}MePhS)_8ZnPc$], Octafluoro-octakis(o-ethylphenylthio) zinc phthalocyanine [$F_8(o\text{-}EtPhS)_8ZnPc$], Octafluoro-octakis(p-ethylphenylthio) zinc phthalocyanine [$F_8(p\text{-}EtPhS)_8ZnPc$], Octafluoro-octakis(o-isopropylphenylthio) zinc phthalocyanine [$F_8(o\text{-}IPrPhS)_8ZnPc$], Octafluoro-octakis(o-butylphenylthio) zinc phthalocyanine [$F_8(o\text{-}BuPhS)_8ZnPc$], Octafluoro-octakis(m-butylphenylthio) zinc phthalocyanine [$F_8(m\text{-}BuPhS)_8ZnPc$], Octafluoro-octakis(p-butylphenylthio) zinc phthalocyanine [$F_8(p\text{-}BuPhS)_8ZnPc$], Octafluoro-octakis(p-tertiary butylphenylthio) zinc phthalocyanine [$F_8(p\text{-}t\text{-}BuPhS)_8ZnPc$], and Octafluoro-octakis(naphthylthio) zinc phthalocyanine [$F_8(NPhS)_8ZnPc$]

The zinc phthalocyanine represented by the general formula I can be produced as follows from 3,4,5,6-tetrafluorophthalonitrile, for example, as a starting material. In an organic solvent such as methanol or acetonitrile, 3,4,5,6-tetrafluorophthalonitrile is caused to react with RSH, RSNa, or RSK, wherein R is a phenyl group or a naphthyl group, for example, in the presence of a condensing agent such as an alkaline substance (KF, for example) to synthesize 3,4,5,6-tetrafluorophthalonitrile having functional groups substituted in advance on each for the fluorine atoms at the 4 and 5 positions thereof. Then, by causing the resultant phthalonitrile now incorporating therein the substituents and zinc powder or a zinc halide to be fused by heating or to be heated in an organic solvent, the zinc phthalocyanine mentioned above is obtained.

The binder resin to be used in the present invention is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (c) at least one styrene compound, and (d) at least one compound selected from among acrylic esters other than hydroxyalkyl acrylates of (a).

The monomer of (a) is at least one compound selected from among hydroxyalkyl acrylates and hydroxyalkyl methacrylates having hydroxyalkyl groups of 2 to 10, preferably 2 to 6, carbon atoms (hereinafter acrylic acid and methacrylic acid will be collectively referred to as "(meth)acrylic acid"). Specifically, the hydroxyalkyl (meth)acrylates which are usable herein include 2-hydroxyethyl (meth)acrylates, 2-hydroxypropyl (meth-)acrylates, 3-hydroxypropyl (meth)acrylates, 2-hydroxybutyl (meth)acrylates, glycerol mono(meth)acrylates, and trimethylol propane (meth)acrylates, for example. The use of the monomer (a) results in improving the electrophotographic properties and the durability as a printing plate. It also contributes to producing a uniform and pretty coating. This favorable effect may be logically explained by a postulate that the introduction of the hydroxy group in the binder resin enhances the fast adhesiveness of the binder resin to the electroconductive substrate and, at the same time, heightens the affinity of the binder resin for the phthalocyanine of the present invention to the extent of improving the dispersibility. It is also effective in heightening the alkali etching property and allowing a decrease in the proportion of the copolymerizable unsaturated carboxylic acid which is liable to impair electrophotographic properties when used in a high ratio.

The ratio of the monomer of (a) to be used is in the range of 0.5 to 40% by weight, preferably 2 to 25% by weight, based on the total amount of the mixed monomer. If this ratio is less than 0.5% by weight or not less than 40% by weight, there arises a disadvantage that the electrophotographic properties and the durability of printing plate are degraded.

The monomer of (b) is at least one copolymerizable unsaturated carboxylic acid. The copolymerizable unsaturated carboxylic acids which are usable herein include such unsaturated monomers as monocarboxylic acids represented by (meth)acrylic acids: dicarboxylic acids represented by maleic acid, itaconic acid, and citraconic acid and dicarboxylic monoesters represented by monoisopropyl maleate which have at least one carboxyl group in the molecular unit thereof. Among other unsaturated monomers mentioned above, (meth)acrylic acids and/or itaconic acid prove to be advantageously useful. The ratio of the monomer of (b) to be used herein is in the range of 10 to 40% by weight, preferably 15 to 30% by weight, based on the total amount of the monomer mixture. If this ratio is less than 10% by weight, there follows a disadvantage that the alkali-solubility of the produced copolymer is unduly low and the etching speed is proportionally low. Conversely, if this ratio exceeds 40% by weight, the photosensitive layer is too deficient in chargeability to be used effectively. For the purpose of acquiring a highly desirable etching property, the copolymer to be used as the binder resin of the present invention may incorporate therein a carboxylic acid so much as to adjust the acid value thereof in the range of 50 to 300 mg-KOH/g. By using the copolymerizable carboxylic acid in the specific range mentioned above, the etching property can be improved without impairing the electrophotographic properties.

The monomer of (c) is a styrene compound. The styrene compounds which are effectively usable herein include styrene and alkyl styrenes such as methyl styrene, ethyl styrene, and isopropyl styrene, for example. Among other styrene compounds mentioned above, styrene proves to be particularly preferable. The ratio of the monomer of (c) to be used is in the range of 10 to 70% by weight, preferably 25 to 55% by weight, based on the total amount of the monomer mixture. If this ratio is less than 10% by weight, there ensues a disadvantage that the strength, the affinity (dispersibility) for phthalocyanine, and the chargeability are unduly low. Conversely, if this ratio exceeds 70% by weight, there ensues a disadvantage that the aforementioned effects due to the use of the monomers of (a) and (b) are no longer manifested because the ratios of the monomers of (a) and (b) are proportionately decrease.

The monomer of (d) is at least one compound selected from among the acrylic esters other than the hydroxyalkyl acrylates usable for the monomer of (a). The acrylic esters which are usable effectively herein include alkyl acrylates having alkyl groups of 1 to 12, preferably 2 to 8, carbon atoms and cycloalkyl acrylates having cycloalkyl groups of 5 to 7 carbon atoms. As typical examples of alkyl acrylates and cycloalkyl acrylates are methyl acrylate, ethyl acrylate, isopropyl acrylate, n-propyl acrylate, 2-ethylhexyl acrylate, lauryl acrylate, cyclohexyl acrylate, and cycloheptyl acrylate. The ratio of an alkyl acrylate or cycloalkyl acrylate to be used is in the range of 5 to 50% by weight, preferably 10 to 40% by weight, based on the total amount of the monomer mixture. So long as this ratio is in the range mentioned above, the added alkyl acrylate or cycloalkyl acrylate enhances the oleophilicity and the produced copolymer enjoys increased binding force and improved flexibility. If this ratio exceeds 50% by weight, there ensues a disadvantage that the aforementioned effects brought about by the use of the monomers of (a), (b) and (c) are no longer manifested because the ratios of the monomers of (a), (b), and (c) are proportionately decreased. The monomer of (e) which is used as occasion demands in the present invention is at least one compound selected from methacrylic esters other than the aforementioned hydroxyalkyl methacrylates. Specifically, the methacrylic esters which are usable herein are alkyl methacrylates having alkyl groups of 1 to 12, preferably 2 to 8, carbon atoms and cycloalkyl methacrylates having cycloalkyl groups of 5 to 7 carbon atoms.

As typical examples of the alkyl methacrylates and cycloalkyl methacrylates, there may be cited methyl methacrylate, ethyl methacrylate, n-propyl methacrylate, isopropyl methacrylate, n-butyl methacrylate, isobutyl methacrylate, sec-butyl methacrylate, t-butyl methacrylate, 2-ethylhexyl methacrylate, cyclohexyl methacrylate, and cycloheptyl methacrylate. The ratio of an alkyl methacrylate or cycloalkyl methacrylate to be used is in the range of 0 to 40% by weight, preferably not more than 15% by weight. So long as this ratio is in the range mentioned above, the added methacrylate goes to enhancing the durability. If this ratio exceeds 40% by weight, however, there ensues a disadvantage that the dispersibility of phthalocyanine is impaired.

Of the various monomer mixtures indicated above, typical monomer mixtures (p-1) to (p-10) indicated below have the compositions and monomer ratios as indicated.

(p-1) 2-Hydroxypropyl acrylate /acrylic acid/styrene/-butyl acrylate (5/20/35/40) (by weight; which invariably applies hereinafter)

(p-2) 2-Hydroxyethyl methacrylate/methacrylic acid/-styrene/butyl acrylate (2/23/40/35), (p-3) 2-Hydroxybutyl methacrylate/acrylic acid/styrene, isopropyl acrylate (15/25/45/15), (p-4) 3-Hydroxypropyl methacrylate/acrylic acid/-styrene/methyl acrylate/ethyl methacrylate (5/20/35/25/15), (p-5) 3-Hydroxybutyl acrylate/methacrylic acid/-styrene/isobutyl acrylate/isopropyl methacrylate (20/30/25/20/5), (p-6) 2-Hydroxyethyl methacrylate/methacrylic acid/-styrene/propyl acrylate/ethyl methacrylate (5/25/40/25/5), (p-7) 2-Hydroxybutyl methacrylate/itaconic acid/-styrene/butyl acrylate/methyl methacrylate (10/15/35/30/10), and (p-8) 3-Hydroxybutyl acrylate/acrylic acid/-styrene/ethyl acrylate/butyl acrylate/butyl methacrylate (5/20/25/40/10).

No particular method is specified for the polymerization of the aforementioned monomer mixture. For example, the monomer mixture can be polymerized by any of the conventional polymerization methods such as the bulk polymerization method, solution polymerization method, and suspension polymerization method in the presence of a radical polymerization initiator such as a peroxide, a hydroperoxide, or azobisisobutylonitrile at a temperature in the range of 50° to 100° C., preferably 70° to 90° C. As regards the manner of addition of the monomer mixture, the method of collective addition, split addition, continuous addition, or a suitable combination thereof may be used.

The number average molecular weight of the copolymer obtained by polymerizing the monomer mixture is in the range of 1,000 to 50,000, preferably 3,000 to 30,000.

The copolymer which is obtained by polymerizing the monomer mixture and which has a number average molecular weight in the range mentioned above is soluble in an alkaline substance. The photosensitive layer which is obtained by applying this copolymer in combination with the aforementioned photoelectroconductive phthlocyanine compound exhibits highly satisfactory alkali-solubility and excels in etching property.

The electrophotographic plate-making quality matrix plate of the present invention is a product obtained by preparing a coating liquid consisting of the aforementioned photoelectroconductive phthalocyanine compound and the aforementioned copolymer as a binder resin and applying the coating liquid to an electroconductive substrate thereby forming a photosensitive layer thereon.

The method for the preparation of the coating liquid is not particularly limited. The preparation may be attained by dissolving or dispersing the binder resin (or the photoelectroconductive phthalocyanine compound) in a suitable solvent and then dissolving or dispersing the photoelectroconductive compound (or the binder resin) in the resultant solution or by dissolving or dispersing the binder resin and the photoelectroconductive phthalocyanine compound severally in different solvents and mixing the resultant solutions. The solvents which are usable for the solution or dispersion of the binder resin and the photoelectroconductive phthalocyanine compound are organic solvents including aromatic hydrocarbons such as benzene and toluene, cyclic ethers such as tetrahydrofuran and dioxane, halogen-containing hydrocarbons such as chloroform, dichloromethane, and dichloroethane, ketones such as acetone and methylethyl ketone, esters such as ethyl acetate, and cellosolves such as methyl cellosolve, for example.

In the preparation of the coating liquid mentioned above, the photoelectroconductive phthalocyanine compound in a ratio in the range of 3 to 50% by weight, preferably 5 to 30% by weight, based on the amount of the binder resin.

The concentrations of the photoelectroconductive phthalocyanine compound and the binder resin dissolved or dispersed in their solvents are both desired to be generally in the range of 0.5 to 50% by weight, preferably 5 to 30% by weight.

The thickness of the photosensitive layer is in the range of 2 to 10 μm, preferably 3 to 6 μm. If the wall thickness is larger than the upper limit of the range, there arises a disadvantage that the etching treatment tends to give rise to side edges and consequently tends to scrape off fine lines. If the wall thickness is smaller than the lower limit of the range, there ensues a disadvantage that the photosensitive layer suffers from inferior chargeability.

According to the present invention, the photosensitive layer is formed on the electroconductive substrate and then it is heat-treated at a temperature in the range of 100° to 160° C., preferably 110° to 140° C. An object for heat-treating is to form partial self-crosslinking between residual hydroxyl groups originated from monomeric hydroxyalkyl acrylate or hydroxyalkyl methaciylate and residual carboxy groups originated from monomeric unsaturated acids in a copolymer obtained by polymerization of the above-mentioned monomer mixture. By the partial self-crosslinking, adhesiveness between the photosensitive layer and the electroconductive substrate can be increased, and it is possible to enhance the printing durability during the printing as the result. If the temperature is less than 100° C., the self-crosslinking is difficult to occur, so lesser effect is obtained. If the temperature is more than 160° C., excess self-crosslinking occurs, and as the result alkali solubility decreases, so the resultant plate becomes low value. That is, the object can be attained by controlling the self-crosslinking appropriately. Heating time is preferable 0.1 to 24 hours although it depends on the temperature.

The coating liquid prepared for the formation of the photosensitive layer of the type to be used as positively charged may, for the purpose of further improving the electrophotographic properties thereof, incorporate additionally therein as a sensitizer at least one compound selected from among organic compounds of polybasic acids such as, for example, compounds represented by the following general formulas III, IV, and V and succinic anhydride and maleic anhydride.

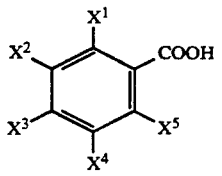

(III)

wherein $X^1$ to $X^5$ are equally or unequally each for hydrogen atom, fluorine atom, —COOH group, or a —$NO_2$ group), (IV)

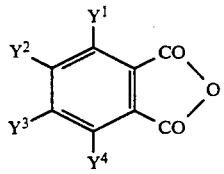

wherein $Y^1$ and $Y^4$ are equally or unequally each for hydrogen atom, fluorine atom, —COOH group, or —$NO_2$ group, and (V)

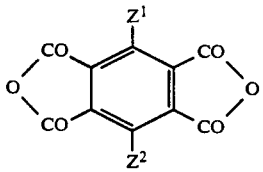

wherein $Z^1$ and $Z^2$ are equally or unequally each for hydrogen atom, fluorine atom, —COOH group, or —$NO_2$ group.

Typical examples of the sensitizer include succinic anhydride, maleic anhydride, phthalic acid, tetrafluorophthalic acid, 4-nitrophthalic acid, phthalic anhydride, tetrafluorophthalic anhydride, 4-nitorphthalic anhydride, trimellitic acid, trimellitic anhydride, benzoic acid, pentafluorobenzoic acid, and tetrafluorobenzoic acid. Among other sensitive enhancers mentioned above, succinic anhydride, tetrafluorophthalic anhydride, benzoic acid, pentafluorobenzoic acid, and tetrafluorobenzoic acid prove to be preferable and tetrafluorophthalic anhydride, pentafluorobenzoic acid, and tetrafluorobenzoic acid prove to be particularly preferable.

The sensitizer is preferable to be used in a ratio in the range of 0.01 to 10% by weight, preferably below 2.0% by weight, based on the amount of the photoelectroconductive phthalocyanine compound.

The coating liquid prepared for the formation of the photosensitive layer which is to be used as charged to negative polarity may, for the purpose of further improving the electrophotographic properties thereof, incorporate additionally therein an electric charge transferring substance such as, for example, an oxazole derivative, an oxadiazole derivative, a pyrazoline derivative, a hydrazone derivative, or a triphenylamine derivative and/or an aminotriazine resin.

It is preferable to use a hydrazone derivative represented by the following general formula VI as an electric charge transferring substance.

(VI)

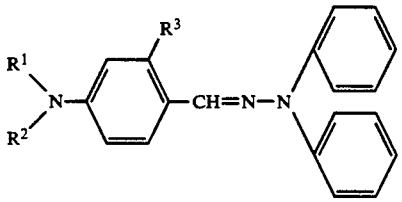

wherein $R^1$ and $R^2$ are each an aryl group or an aralkyl group and $R^3$ is hydrogen atom, an alkyl group of 1 to 4 carbon atoms, a benzyl group, an alkoxy group of 1 to 4 carbon atoms, a phenoxy group, or a benzyloxy group.

As typical examples of the hydrazine compounds represented by the aforementioned general formula, the following compounds may be cited.

(CT-1)

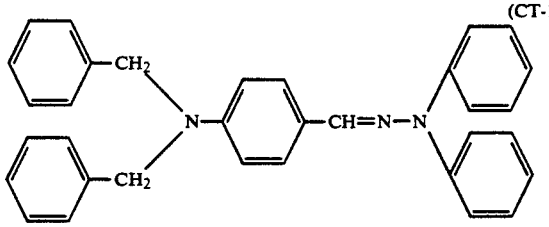

(CT-2)

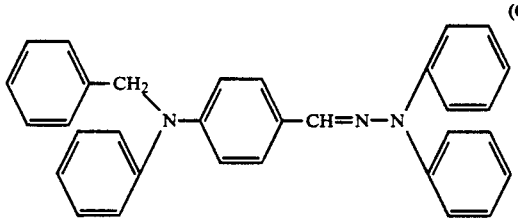

(CT-3)

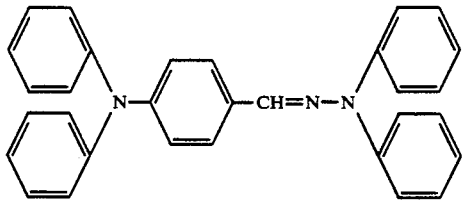

(CT-4)

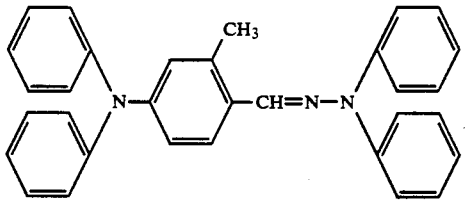

(CT-5)

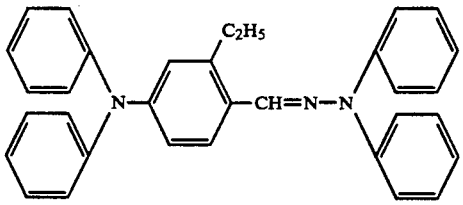

(CT-6)

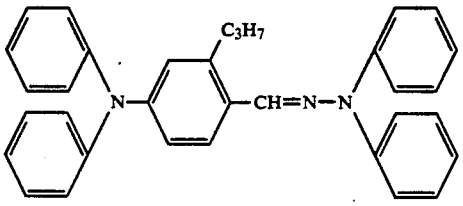

-continued (CT-7)

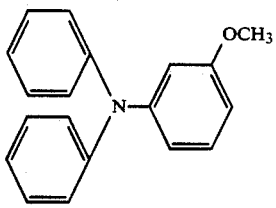

(CT-8)

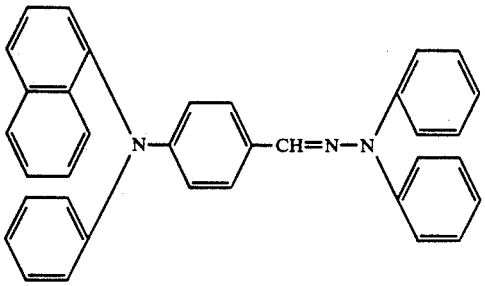

(CT-9)

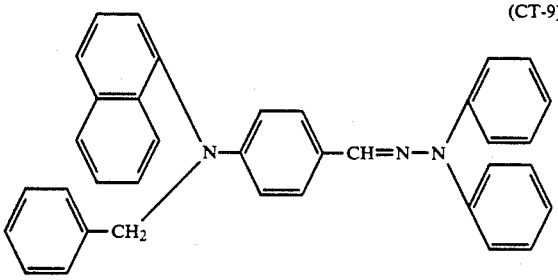

(CT-10)

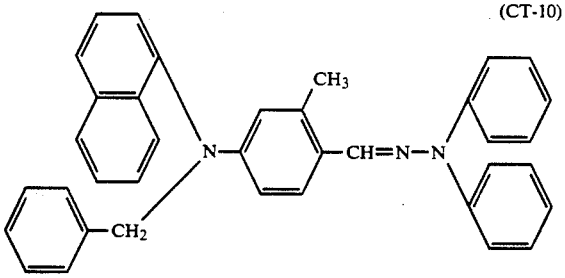

(CT-11)

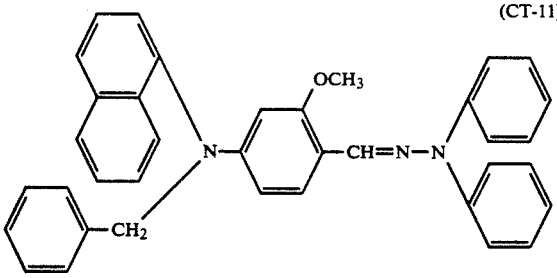

(CT-12)

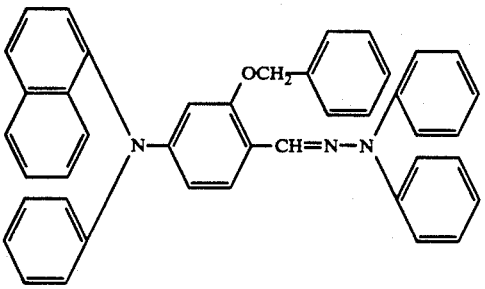

-continued (CT-13)

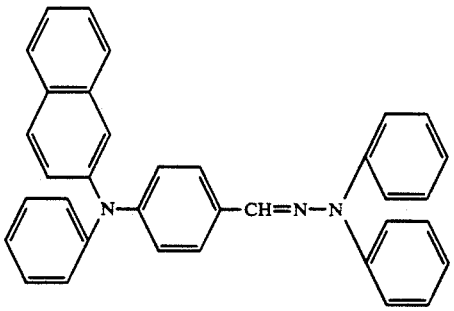

The aminotriazone resins which are usable herein include melamine resin, benzoguanamine resin, acetoguanamine resin, CTU-guanamine resin (proprietary product of Ajinomoto Co., Inc.), and cyclohexyl guanamine, for example. It is particularly preferable to use cyclohexyl carboguanamine resin among other aminotriazine resins mentioned above.

The aminotriazine resin is an aminotriazine resin composition, namely the oxymethylated or alkyloxymethylated product of aminotriazine, obtained by the reaction of aminotriazine with formaldehyde optionally further with an alcohol such as butanol. It is used either in the unmodified form thereof or in a form suitably condensed by dehydration. It is preferable to use the aforementioned electric charge transferring substance and/or aminotriazine resin in a ratio not exceeding 60% by weight, preferably falling in the range of 0.1 to 20% by weight.

The electroconductive substrate to be used in the present invention is not particularly limited. The electroconductive substrates which are usable effectively herein include monometallic plates such as aluminum plate and zinc plate, bimetal plates such as copper-aluminum plate, copper-stainless steel plate, and chromium-copper plate, and trimetallic plates such as chromium-copper-aluminum plate, chromium-copper iron plate, and chromium-copper-aluminum plate invariably possessing a hydrophilic surface and finding popular use. The thickness of the electroconductive substrate is desired to be approximately in the range of 0.05 to 0.5 mm.

Particularly, in the case of a substrate having an aluminum surface, it is preferable to have undergone a surface treatment such as abrasion with sand, immersion in an aqueous solution of sodium silicate or potassium fluorozirconate, or anodix oxidation.

The treatment of anodix oxidation can be carried out by placing an aluminum plate in an electrolytic solution formed of the solution of an inorganic acid such as phosphoric acid, chromic acid, sulfuric acid, or boric acid, an organic acid such as oxalic acid or sulfamic acid, or any of the salts of such acids, and flowing an electric current through the aqueous solution with the aluminum plate as an anode. Further, it is preferable to provide an intermediate layer comprising a resin having a composition within the range of the present invention having higher acid value than the binder resin in the sensitive layer between the electroconductive substrate and electrophotosensitive layer in order to enhance the printing quality in the present invention.

The electrophotographic plate-making quality matrix plate of the present invention is not discriminated on account of the method to be employed for the production thereof. This production can be accomplished by any of the methods heretofore known to the art. In accordance with the conventional electrophotographic technique, for example, a toner image is obtained on a photosensitive layer by first uniformly charging the photosensitive layer in a dark place with a corona charging device, subjecting the charged photosensitive layer to the reflection image exposure using such a light source as a tungsten lamp, a halogen lamp, a xenon lamp, or a fluoroescent lamp, the tight-contact image exposure through a transparent positive film, or the scanning exposure with a laser beam such as a He-Ne laser, an argon laser, or a semiconductor laser thereby forming an electrostatic latent image therein, developing this latent image with a toner, and thermally fixing the developed toner image.

The toner must be hydrophobic and capable of receiving ink, adhesive to the matrix plate so much as to withstand the impact of printing, and resistant to the action of an alkaline aqueous etching liquid to be used during the course of etching. As the electrophotographic developer, since a liquid developer excels a powdery developer in resolving power, it is more preferable to use the former developer than the latter developer. For the toner to fulfill the requirements mentioned above, the resin which the toner is preferable to contain is styrene resin, acrylic resin, styrene-acrylic resin, styrene-methacrylic resin, polyester resin, or epoxy resin, for example. The dispersant for the toner is an organic solvent possessing a low dielectric constant and a high insulating capacity. An isoparaffin type hydrocarbon, for example, is used preferable. The toner may incorporate therein a pigment or dye for the purpose of coloration or an electric charge regulating agent for the purpose of imparting positive charge or negative charge in an amount incapable of exerting any adverse effect upon the stability and the fixing property of the toner and yet fit for the purpose for which the toner is used.

When the plate-making matrix plate on which the toner image has been formed as described above is immersed in an alkaline dissolving liquid, the photosensitive layer in the non-image part not masked with the toner image is dissolved and removed to expose the hydrophilic surface of the electroconductive substrate and the image part of the toner image is allowed to remain on the surface of the substrate to give rise to a lithographic printing plate aimed at.

The alkaline dissolving liquids which are effectively usable for the solution and removal of the photosensitive layer in the non-image part include alkaline aqueous solution and removal of the photosensitive layer in the non-image part include alkaline aqueous solutions of inorganic salts such as sodium silicate, sodium phosphate, sodium hydroxide, and sodium carbonate, alkaline aqueous solutions of organic amines such as triethanol amine and ethylene diamine, and solutions incorporating therein organic solvents such as ethanol, benzyl alcohol, ethylene glycol, and glycerol or surfactants, for example. An alkaline aqueous etching liquid of the following composition, for example, can be used advantageously.

| | |
|---|---|
| Edta-4H | 4 g |
| Benzyl alcohol | 30 g |
| Monoethanol amine | 5 g |

-continued

| | |
|---|---|
| Triethanol amine | 60 g |
| NaOH | 25 g |

Water added to dilute the compounds mentioned above to a total volume of 1 liter.

The electrophotographic plate-making quality matrix plate may be otherwise used as a laser printer (OPC) quality electrophotographic sensitive material. In the laser printer, the developed toner is transferred onto a sheet of paper and fixed thereon.

Now, the present invention will be described more specifically below with reference to production examples and working examples. Wherever "parts" and "percentages" are mentioned, they are meant as "parts by weight" and "percents by weight" unless otherwise specified.

PRODUCTION EXAMPLE 1

Production of $F_8(PhS)_8ZnPc$

(1) Synthesis of starting material

In a four-neck flask having an inner volume of 200 ml, 19.6 g (98 m.mols) of 3,4,5,6 -tetrafluiorophthalonitrile, 21.6 g (196 m.mols) of thiophenol, 17.1 g (294 m.mols) of potassium fluoride (KF), and 100 ml of acetonitrile were placed and stirred at 50° C. for reaction for 12 hours. Then, the reaction mixture was cooled to room temperature. The yellow solid which formed consequently in the mixture was separated by filtration. The cake thus obtained was purified by washing first with methanol and then with hot water, to obtain 34.5 g of 3,6-difluoro-4,5-bisphenylthiophthalonitrile (yield: 92.5 mol % based on 3,4,5,6-tetrafluoronitrile).

(2) Synthesis of $F_8(PhS)_8ZnPc$

In a four-neck flask having an inner volume of 100 ml, 10 g (26.2 m.mols) of 3,6-difluoro-4,5-bisphenyl thiophthalonitrile, 3.14 g (9.8 m.mols) of zinc iodide, and 50 ml of benzonitrile were placed and then stirred at 175° C. for reaction for 6 hours. Then, the reaction mixture was cooled. The green solid consequently formed in the reaction mixture was separated by filtration, washed in a Soxhlet extractor with methanol, benzene, and acetone sequentially in the roder mentioned, to obtain $F_8(PhS)_8ZnPc$ in a yield of 79.4 mol % based on 3,6-difluoro- 4,5 -bisphenylthiophthalonitrile.

PRODUCTION EXAMPLE 2

Production of copolymer

The copolymer can be produced as follows, for example. In a separable flask provided with a stirrer, a thermometer, a condenser, a nitrogen inlet tube, a monomer mixture dropping funnel, and a polymerization initiator dropping funnel, 40 parts of isopropanol is placed as a solvent and then nitrogen is introduced through the nitrogen inlet tube to displace the air entrapped in the flask with the nitrogen. Subsequently, 60 parts of a monomer mixture is placed in the monomer mixture dropping funnel and 0.1 part of azobisisobutyronitrile is placed in the polymerization initiator dropping funnel. With the inner temperature of the flask kept at 80° C., the monomer mixture and the polymerization initiator are dropped into the flask over a period of two hours. The mixture in the flask is heated at 80° C. for two hours and then at 85° to 95° C. for two hours and then cooled.

EXAMPLE 1

In a paint shaker dispersion device, 1.5 parts of $F_8$(o-MePhS)$_8$ZnPc, 0.05 part of pentafluorobenzoic acid, 12.0 parts of a copolymer obtained from the monomer mixture (P-1), and 83 parts of dichloroethane were shaken for dispersion for 2 hours. The resultant dispersion was applied on an aluminum plate which had been abraded in a thickness of 0.15 mm with a barcoater and further treated for anodic oxidation. The applied layer of the dispersant was dried with hot wind at 60° C. for 30 minutes, then desiccated under a vacuum (1 mmHg) at 100° C. for 2 hours, and then heated at 110° C. for 3 hours, to form a photosensitive layer. The film (photosensitive layer) thus obtained had a thickness of 5 μm.

The monolayer type electrophotographic sensitive material obtained as an electrophotographic plate-making quality matrix plate as described above was positively charged at +6.0 kV with an electrostatic paper analyzer (produced by Kawaguchi Denki K.K. and marketed under product code of "SP-428").

The photosensitive material was then retained in a dark place for 5 seconds, exposed to white light (from a tungsten lamp) with an illuminance of 5 luxes for 5 seconds to test for charging properties [surface potential ($V_0$), potential ($V_5$) after 5 seconds retention in the dark place, and amount of exposure required for the potential existing before the exposure to attenuate to 178 by exposure ($E_{\frac{1}{2}}$) (Lux.sec)]. It was then exposed to a monochromatic light of 780 nm separated by dispersion with a spectral filter to 0.5 μw/cm$^2$ to determine half-value exposure energy sensitivity (μJ/cm$^2$).

Then, the monolayer type electrophotographic sensitive material was immersed in an aqueous 0.5% sodium hydroxide solution and then washed with water to remove the photosensitive layer. In this case, the alkali dissolving property was evaluated in terms of the speed of removal of the photosensitive layer.

Subsequently, the same monolayer type electrophotographic sensitive material separately formed on an abraded aluminum plate was subjected to platemaking by the liquid developing process using a TTP laser plate-making device produced by Toppan Printing Co., Ltd. Corona charging was effected at +6 kV. The electrostatic latent image was developed with a negatively polarized developer. The developed image was thermally fixed to form a toner image.

The toner image thus formed was washed out with an alkaline aqueous etching solution and washed with water to produce a lithographic printing plate.

The printing plate thus produced was set in place in an offset printing device and used to produce prints by the conventional process. The initially produced prints and the prints produced after 100,000th print were evaluated for degree of scumming and clarity of print.

The results of the evaluation of electrophotographic properties, alkali dissolving property, and printing quality are shown in Table 2.

EXAMPLES 2 TO 17

Electrophotographic plate-making quality matrix plates were produced by following the procedure of Example 1, except that varying photoelectroconductive phthalocyanine compounds indicated in Table 1, copolymers obtained from various monomer mixtures (P-1) to (P-8), sensitizers were used in the place of $F_8$(o-MePhS)$_8$ZnPc and the copolymer of the monomer mixture (P-1), and heat-treatment conditions and thickness indicated in Table 1 were adapted. They were evaluated for electrophotographic properties, alkali-dissolving property, and printing quality. The results are shown in Table 2. The electrophotographic sensitive materials produced as described above were left standing in a room illuminated with a fluorescent lamp for 2 months and then tested for electrophotographic properties and printing quality. The properties showed virtually no difference before and after the two months' standing.

CONTROLS 1 TO 6

Electrophotographic plate-making quality matrix plates were produced by following the procedure of Example 1, except that various photoelectroconductive phthalocyanine compounds indicated in FIG. 1, the copolymers obtained from the monomer mixtures of (P-1) and (P-8), the monomer mixtures, (S-1) to (S-5), shown below produced in the same manner as in Production Example 2, and sensitizers, and heat-treatment conditions and thickness indicated in Table 1 were adopted. They were similarly evaluated for electrophotographic properties, alkali-dissolving property, and printing quality. The results are shown in Table 2.

(S-1) Acrylic acid/butyl acrylate/butyl methacrylate (25/20/55), (S-2) Methacrylic acid/styrene/isopropyl acrylate (30/15/55), (S-3) Methacrylic acid/methyl acrylate/ethyl methacrylate (15/60/25), (S-4) Acrylic acid/styrene/ethyl acrylate/methyl methacrylate (25/8/20/47), and (S-5) Acrylic acid/butyl acrylate/methyl methacrylate/2-hydroxyethyl methacrylate (10/40/40/10)

TABLE 1

| | Photoelectroconductive phthalocyanine compound | | Copolymer | | Sensitizer | | Thickness of film (μm) | Heat-treatment conditions | |
|---|---|---|---|---|---|---|---|---|---|
| | Kind | Amount (part) | Kind | Amount (part) | Kind | Amount (part) | | Temperature (°C.) | Time (hr) |
| Example 2 | $F_8$(p-t-BuPhS)$_8$ZnPc | 2.5 | P-1 | 12.0 | non-use | — | 5 | 120 | 2.0 |
| Example 3 | $F_8$(m-MePhS)$_8$ZnPc | 3.0 | P-2 | 12.0 | non-use | — | 5 | 130 | 1.0 |
| Example 4 | $F_8$(PhS)$_8$ZnPc | 2.0 | P-1 | 12.0 | pentafluorobenzoic acid | 0.05 | 4 | 140 | 0.3 |
| Example 5 | $F_8$(m-MePhS)$_8$ZnPc | 2.5 | P-1 | 12.0 | succinic anhydride | 0.1 | 5 | 120 | 1.5 |
| Example 6 | $F_8$(2,4-MePhS)$_8$ZnPc | 2.5 | P-2 | 12.0 | pentafluorobenzoic acid | 0.05 | 5 | 130 | 1.0 |
| Example 7 | $F_8$(PhS)$_8$ZnPc | 3.0 | P-2 | 12.0 | benzoic acid | 0.1 | 5 | 140 | 0.4 |
| Example 8 | $F_8$(PhS)$_8$ZnPc | 2.0 | P-3 | 12.0 | pentafluorobenzoic acid | 0.05 | 6 | 130 | 1.0 |
| Example 9 | $F_8$(o-MePhS)$_8$ZnPc | 1.5 | P-4 | 12.0 | phthalic anhydride | 0.05 | 5 | 130 | 1.0 |

TABLE 1-continued

| | Photoelectroconductive phthalocyanine compound | | Copolymer | | Sensitizer | | | Heat-treatment conditions | |
|---|---|---|---|---|---|---|---|---|---|
| | Kind | Amount (part) | Kind | Amount (part) | Kind | Amount (part) | Thickness of film (μm) | Temperature (°C.) | Time (hr) |
| Example 10 | $F_8(p\text{-}MePhS)_8ZnPc$ | 2.0 | P-5 | 12.0 | pentafluorobenzoic acid | 0.03 | 6 | 120 | 2.0 |
| Example 11 | $F_8(2,4\text{-}MePhS)_8ZnPc$ | 3.0 | P-5 | 12.0 | phthalic anhydride | 0.015 | 5 | 110 | 3.0 |
| Example 12 | $F_8(PhS)_8ZnPc$ | 1.5 | P-6 | 12.0 | tetrafluorophthalic anhydride | 0.03 | 5 | 140 | 0.3 |
| Example 13 | $F_8(2,4\text{-}MePhS)_8ZnPc$ | 2.0 | P-6 | 12.0 | tetrafluorophthalic anhydride | 0.05 | 3 | 130 | 0.8 |
| Example 14 | $F_8(PhS)_8ZnPc$ | 1.0 | P-7 | 12.0 | tetrafluorophthalic anhydride | 0.05 | 5 | 140 | 0.4 |
| Example 15 | $F_8(NPhS)_8ZnPc$ | 2.0 | P-7 | 12.0 | tetrafluorophthalic anhydride | 0.1 | 5 | 110 | 3.5 |
| Example 16 | $F_8(2,4\text{-}MePhS)_8ZnPc$ | 3.0 | P-8 | 12.0 | tetrafluoro benzoic acid | 0.1 | 3 | 130 | 1.0 |
| Example 17 | $F_8(m\text{-}MePhS)_8ZnPc$ | 2.5 | P-8 | 12.0 | tetrafluoro benzoic acid | 0.03 | 4 | 120 | 1.5 |
| Control 1 | α-type copper phthalocyanine | 2.0 | P-5 | 12.0 | benzoic acid | 0.05 | 5 | 110 | 3.0 |
| Control 2 | ε-type copper phthalocyamine | 1.5 | S-1 | 12.0 | benzoic acid | 0.05 | 5 | 110 | 3.0 |
| Control 3 | $F_8(o\text{-}MePhS)_8ZnPc$ | 2.5 | S-2 | 12.0 | benzoic acid | 0.05 | 5 | 110 | 3.0 |
| Control 4 | α-type TiOPc | 3.0 | S-3 | 12.0 | benzoic acid | 0.05 | 5 | 110 | 3.0 |
| Control 5 | α-type TiOPc | 2.5 | S-4 | 12.0 | benzoic acid | 0.05 | 5 | 110 | 3.0 |
| Control 6 | $F_8(PhS)_8ZnPc$ | 2.5 | S-5 | 12.0 | benzoic acid | 0.05 | 5 | 120 | 2.0 |

TABLE 2

| | Surface potential $V_0$ (V) | Potential in dark place $V_5$ (V) | Half value exposure amount ($E_{\frac{1}{2}}$) Exposed to tunguster lamp (Lux · sec) | Exposure to light of 780 nm (μJ/cm²) | Speed of alkali dissociation (sec) | Printing quality |
|---|---|---|---|---|---|---|
| Example 1 | 494 | 450 | 4.3 | 2.9 | 10~20 | A |
| Example 2 | 453 | 394 | 3.8 | 2.6 | 10~20 | A |
| Example 3 | 431 | 374 | 4.2 | 3.1 | 10~20 | B |
| Example 4 | 449 | 416 | 2.8 | 1.9 | 10~20 | A |
| Example 5 | 457 | 411 | 2.1 | 1.4 | 10~20 | B |
| Example 6 | 423 | 378 | 1.8 | 1.2 | 10~20 | A |
| Example 7 | 393 | 352 | 1.6 | 1.0 | 10~20 | B |
| Example 8 | 439 | 405 | 3.3 | 2.2 | 10~20 | A |
| Example 9 | 476 | 453 | 3.9 | 2.6 | 10~20 | A |
| Example 10 | 402 | 358 | 3.4 | 2.2 | 10~20 | A |
| Example 11 | 405 | 355 | 3.7 | 2.5 | 5~15 | B |
| Example 12 | 438 | 414 | 3.4 | 2.3 | 10~20 | A |
| Example 13 | 400 | 371 | 2.5 | 1.6 | 5~15 | A |
| Example 14 | 468 | 443 | 4.0 | 2.7 | 10~20 | A |
| Example 15 | 414 | 380 | 4.5 | 3.0 | 10~20 | B |
| Example 16 | 395 | 346 | 1.5 | 1.0 | 5~15 | A |
| Example 17 | 393 | 352 | 3.0 | 2.0 | 5~15 | A |
| Control 1 | 333 | 243 | no sensitivity | not measured | | E |
| Control 2 | 341 | 291 | 6.3 | not measured | 10~20 | C, D |
| Control 3 | 251 | 193 | 4.4 | not measured | 5~15 | C |
| Control 4 | 325 | 261 | 4.3 | not measured | 20~30 | C, D |
| Control 5 | 314 | 265 | 5.1 | not measured | 20~30 | C |
| Control 6 | 362 | 305 | 3.7 | not measured | Over 30 sec | C |

Surface potential, $V_0$ (V)
Potential in dark place, $V_5$ (V)
Half-value exposure amount ($E_{\frac{1}{2}}$)
Exposed to tungsten lamp (Lux · sec)
Exposure to light of 780 nm (μj/cm²)
Speed of alkali dissolution (sec)
Printing quality
A: Capable of producing 100,000 very clear prints free from smeared background and from worn lines.
B: Capable of producing 100,000 clear prints free from smeared background and not from worn lines.
C: Productive of prints suffering from smeared background or inferior clarity.
D: Peeling of plate surface observed after production of 100,000 prints.
E: No toner image obtained and no printing attained.

EXAMPLES 18 TO 27

Electrophotographic plate-making quality matrix plates were produced by following the procedure of Example 1, except that the various photoelectroconductive phthalocyanine compounds indicated in Table 3 and the copolymers obtained from the monomer mixtures of (P-1) to (P-8) were used in the place of the $F_8(o\text{-}MePhS)_8ZnPc$ and the copolymer of the monomer mixture of (P-1). The monolayer type electrophotographic plate-making quality matrix plates as described above were negatively charged at −6.0 kV with an electrostatic paper analyzer. They were evaluated for electrophotographic properties, alkali-dissolving property, and printing quality in the same manner as in Example 1. The results are shown in Table 4.

TABLE 3

| | Photoelectroconductive phthalocyanine compound | | Copolymer | | Sensitizer | | | Heat-treatment conditions | |
|---|---|---|---|---|---|---|---|---|---|
| | Kind | Amount (part) | Kind | Amount (part) | Kind | Amount (part) | Thickness of film (μm) | Temperature (°C.) | Time (hr) |
| Example 18 | $F_8(m\text{-}MePhS)_8ZnPc$ | 3.0 | P-1 | 12.0 | CT-1 | 0.05 | 5 | 120 | 2.0 |
| Example 19 | $F_8(2,4\text{-}MePhS)_8ZnPc$ | 2.0 | P-2 | 12.0 | — | — | 4 | 130 | 1.0 |
| Example 20 | $F_8(o\text{-}MePhS)_8ZnPc$ | 3.0 | P-1 | 12.0 | DBG | 0.6 | 5 | 130 | 1.0 |
| Example 21 | $F_8(PhS)_8ZnPc$ | 2.0 | P-2 | 12.0 | DCHG | 0.8 | 4 | 140 | 0.4 |
| Example 22 | $F_8(p\text{-}MePhS)_8ZnPc$ | 3.0 | P-3 | 12.0 | CT-4 | 0.05 | 5 | 120 | 1.5 |
| Example 23 | $F_8(o\text{-}MePhS)_8ZnPc$ | 2.0 | P-4 | 12.0 | CT-5 | 0.1 | 4 | 120 | 2.0 |
| Example 24 | $F_8(PhS)_8ZnPc$ | 3.0 | P-5 | 12.0 | BG-600 | 1.0 | 5 | 130 | 0.8 |
| Example 25 | $F_8(p\text{-}MePhS)_8ZnPc$ | 2.0 | P-6 | 12.0 | CT-7 | 0.03 | 4 | 140 | 0.5 |
| Example 26 | $F_8(2,4\text{-}MePhS)_8ZnPc$ | 3.0 | P-7 | 12.0 | CT-8 | 0.05 | 5 | 120 | 2.0 |
| Example 27 | $F_8(PhS)_8ZnPc$ | 2.0 | P-8 | 12.0 | — | — | 4 | 140 | 0.4 |

TABLE 4

| | Surface potential $V_0$ (V) | Potential in dark place $V_5$ (V) | Half value exposure amount ($E_{\frac{1}{2}}$) Exposed to tunguster lamp (Lux · sec) | Exposure to light of 780 nm (μJ/cm²) | Speed of alkali dissociation (sec) | Printing quality |
|---|---|---|---|---|---|---|
| Example 18 | −431 | −355 | 3.0 | 2.1 | 10~20 | B |
| Example 19 | −408 | −357 | 3.8 | 2.7 | 10~20 | A |
| Example 20 | −443 | −380 | 2.4 | 1.6 | 10~20 | A |
| Example 21 | −402 | −368 | 2.5 | 1.7 | 10~20 | A |
| Example 22 | −426 | −351 | 2.8 | 1.9 | 10~20 | A |
| Example 23 | −383 | −328 | 3.1 | 2.3 | 10~20 | B |
| Example 24 | −409 | −347 | 2.7 | 1.9 | 5~15 | A |
| Example 25 | −395 | −334 | 3.3 | 2.5 | 10~20 | B |
| Example 26 | −434 | −362 | 2.9 | 2.1 | 10~20 | A |
| Example 27 | −398 | −353 | 3.7 | 2.8 | 10~20 | A |

DBG: Oxymethylated benzoguanamine condensate (molecular weight 480)
DCHG: Oxymethylated cyclohexyl carboguanamine condensate (molecular weight 780)
BG600: Butyl ether oxymethylated benzoguanamine condensate (molecular weight 600)

What is claimed is:

1. An electrophotographic plate-making quality matrix plate provided on an electroconductive substrate thereof with a photosensitive layer formed of an alkali-soluble binder resin containing an organic photoelectroconductive compound, which matrix plate is characterized by the fact that said organic photoelectroconductive compound is a zinc phthalocyanine represented by the general formula I:

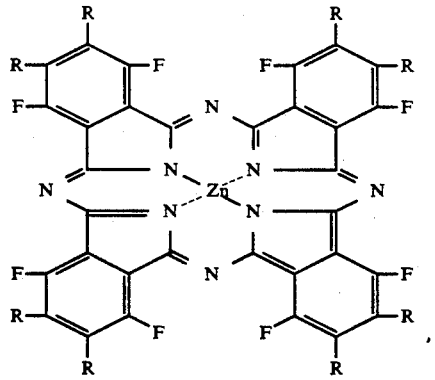

(I)

wherein R is a —SZ group (where Z is a phenyl group, a phenyl group substituted with an alkyl group of 1 to 5 carbon atoms, or a naphthyl group), and said binder resin is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (c) at least one styrene compound, and (d) at least one compound selected from among acrylic esters other than said hydroxyalkyl acrylates of (a).

2. An electrophotographic plate-making matrix plate according to claim 1, wherein said monomer mixture comprises at least one compound selected from among methacrylic esters other than said hydroxyalkyl methacrylates of (a).

3. An electrophotographic plate-making matrix plate according to claim 2, wherein said binder resin is a copolymer of a number average molecular weight in the range of 1,000 to 50,000 obtained by the polymerization of a monomer mixture composed of (a) 0.5 to 40% by weight of at least one compound selected from the group consisting of hydroxyalkyl acrylates and hydroxyalkyl methacrylates having alkyl groups of 2 to 10 carbon atoms, (b) 10 to 40% by weight of at least one copolymerizable carboxylic acid selected from the group consisting of acrylic acid, methacrylic acid, and itaconic acid, (c) 10 to 70% by weight of at least one styrene compound, (d) 5 to 50% by weight of at least one acrylic ester selected from the group consisting of alkyl acrylates having alkyl groups of 1 to 12 carbon atoms and cycloalkyl acrylates having cycloalkyl groups of 5 to 7 carbon atoms, and (e) 0 to 40% by weight of at least one methacrylic ester selected from the group consisting of alkyl methacrylates having alkyl groups of 1 to 12 carbon atoms and cycloalkyl methacrylates having cycloalkyl groups of 5 to 7 carbon atoms.

4. An electrophotographic plate-making matrix plate according to any of claims 1 to 3, wherein said photosensitive layer to be used as charged to positive polarity contains a sensitizer.

5. An electrophotographic plate-making matrix plate according to claim 4, wherein said sensitizer is at least one compound selected from the group consisting of the compounds represented by the following general formulas, III, IV, and V, succinic anhydride, and maleic anhydride:

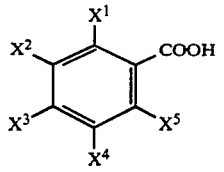

(III)

wherein $X^1$ to $X^5$ are, either equally or unequally, each hydrogen atom, fluorine atom, —COOH group, or —$NO_2$ group,

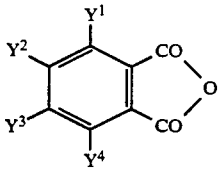

(IV)

wherein $Y^1$ to $Y^4$ are, either equally or unequally, each hydrogen atom, fluorine atom, —COOH group, or —$NO_2$ group, and

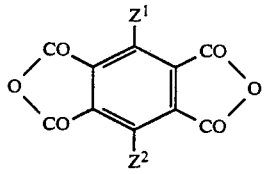

(V)

wherein $Z^1$ and $Z^2$ are, either equally or unequally, each hydrogen atom, fluorine atom, —COOH group, or —$NO_2$ group.

6. An electrophotographic plate-making matrix plate according to any of claims 1 to 3, wherein said photosensitive layer to be used as charged to negative polarity contains at least one charge transferring substance selected from among oxazole derivatives, oxadiazole derivatives, pyrazoline derivatives, hydrazone derivatives, and triphenylamine derivatives.

7. An electrophotographic plate-making matrix plate according to claim 6, wherein said charge transferring substance is represented by the following general formula VI:

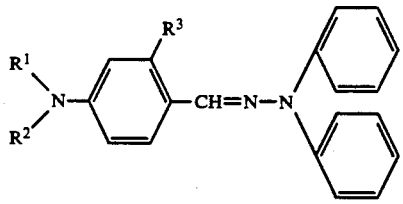

(VI)

wherein $R^1$ and $R^2$ are each is an aryl group or an aralkyl group and $R^3$ is hydrogen atom, an alkyl group of 1 to 4 carbon atoms, a benzyl group, an alkoxy group of 1 to 4 carbon atoms, a phenoxy group, or a benzyloxy group.

8. An electrophotographic plate-making matrix plate according to any of claims 1 to 3, wherein said photosensitive layer to be used as charged to negative polarity contains aminotriazine resin.

9. An electrophotographic plate-making matrix plate according to claim 8, wherein said aminotriazine resin is at least one member selected from the group consisting of benzoguanamine resin compositions, cyclohexylcarboguanamine resin compositions, melamine resin compositions, and acetoguanamine resin compositions.

10. An electrophotographic plate-making matrix plate according to claim 8, wherein said aminotriazine resin and a composition thereof are respectively the condensate of oxymethylated aminotriazine and the condensate of alkylether oxymethylated aminotriazine.

11. An method for preparing an electrophotographic plate-making quality matrix plate which comprises coating on an electroconductive substrate thereof with a photosensitive layer formed of an alkali-soluble binder resin containing a photoelectroconductive organic compound is characterized by the fact that said photoelectroconductive organic compound is a zinc phthalocyanine represented by the general formula I:

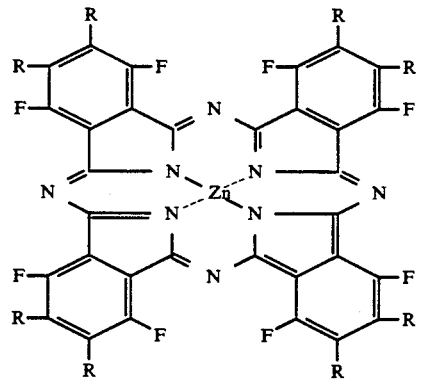

(I)

wherein R is a —SZ group (where Z is a phenyl group, a phenyl group substituted with an alkyl group of 1 to 5 carbon atoms, or a naphthyl group), and said binder resin is a copolymer obtained by polymerizing a monomer mixture comprising (a) at least one compound selected from the group consisting of hydroxyalkyl acrylates and hydroxyalkyl methacrylates, (b) at least one copolymerizable unsaturated carboxylic acid, (c) at least one styrene compound, and (d) at least one compound selected from among acrylic esters other than said hydroxyalkyl acrylates of (a) and heat-treating said coated substrate.

12. A method according to claim 11, wherein said heat-treatment is carried out at a temperature in the range of 100° to 160° C.

13. A method according to claim 11, wherein said monomer mixture comprises at least one compound selected from among methacrylic esters other than said hydroxyalkyl methacrylates of (a).

14. A method according to claim 13, wherein said binder resin is a copolymer of a number average molecular weight in the range of 1,000 to 50,000 obtained by the polymerization of a monomer mixture composed of (a) 0.5 to 40% by weight of at least one compound selected from the group consisting of hydroxyalkyl acrylates and hydroxyalkyl methacrylates having alkyl groups of 2 to 10 carbon atoms, (b) 10 to 40% by weight of at least one copolymerizable carboxylic acid selected from the group consisting of acrylic acid, methacrylic acid, and itaconic acid, (c) 10 to 70% by weight of at least one styrene compound, (d) 5 to 50% by weight of at least one acrylic ester selected from the group consisting of alkyl acrylates having alkyl groups of 1 to 12 carbon atoms and cycloalkyl acrylates having cycloalkyl groups of 5 to 7 carbon atoms, and (e) 0 to 40% by weight of at least one methacrylic ester selected from the group consisting of alkyl methacrylates having alkyl groups of 1 to 12 carbon atoms and cycloalkyl methacrylates having cycloalkyl groups of 5 to 7 carbon atoms.

15. A method according to any of claims 11 to 14, wherein said photosensitive layer to be used as charged to positive polarity contains a sensitizer.

16. A method according to claim 15, wherein said sensitizer is at least one compound selected from the group consisting of the compounds represented by the following general formulas, III, IV, and V, succinic anhydride, and maleic anhydride:

(III)

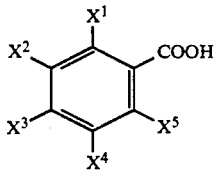

wherein $X^1$ to $X^5$ are, either equally or unequally, each hydrogen atom, fluorine atom, —COOH group, or —$NO_2$ group, (IV)

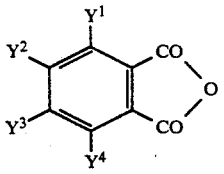

wherein $Y^1$ to $Y^4$ are, either equally or unequally, each hydrogen atom, fluorine atom, —COOH group, or —$NO_2$ group, and (V)

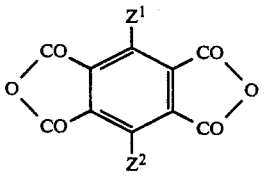

wherein $Z^1$ and $Z^2$ are, either equally or unequally, each hydrogen atom, fluorine atom, —COOH group, or —$NO_2$ group.

17. A method according to any of claims 11 to 14, wherein said photosensitive layer to be used as charged to negative polarity contains at least one charge transferring substance selected from among oxazole derivatives, oxadiazole derivatives, pyrazoline derivatives, hydrazone derivatives, and triphenylamine derivatives.

18. A method according to claim 17, wherein said charge transferring substance is represented by the following general formula VI:

(VI)

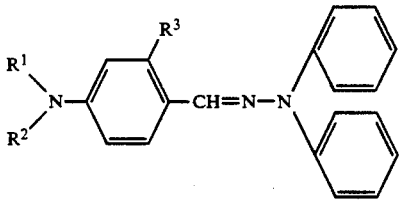

wherein $R^1$ and $R^2$ are each is an aryl group or an aralkyl group and $R^3$ is hydrogen atom, an alkyl group of 1 to 4 carbon atoms, a benzyl group, an alkoxy group of 1 to 4 carbon atoms, a phenoxy group, or a benzyloxy group.

19. A method according to any of claims 11 to 14, wherein said photosensitive layer to be used as charged to negative polarity contains aminotriazine resin.

20. A method according to claim 19, wherein said aminotriazine resin is at least one member selected from the group consisting of benzoguanamine resin compositions, cyclohexylcarboguanamine resin compositions, melamine resin compositions, and acetoguanamine resin compositions.

21. A method according to claim 19, wherein said aminotriazine resin and a composition thereof are respectively the condensate of oxymethylated aminotriazine and the condensate of alkylether oxymethylated aminotriazine.

22. A lithographic printing plate obtained by forming a toner image by the electrophotographic process on an electrophotographic plate-making quality matrix plate according to any of claims 1 to 10, fixing said toner image, and then removing the non-image part of said toner image with an alkaline etching liquid.

* * * * *